US009820587B1

(12) United States Patent
Cheng et al.

(10) Patent No.: US 9,820,587 B1
(45) Date of Patent: Nov. 21, 2017

(54) MERCHANDISE SECURITY HOOK

(71) Applicant: Guangzhou Hybon Electronic Technology Co., Limited, Guangzhou, Guangdong (CN)

(72) Inventors: Jinbo Cheng, Guangdong (CN); Luping Shen, Guangdong (CN)

(73) Assignee: Guangzhou Hybon Electronic Technology Co., Limited, Guangzhou (CN)

( * ) Notice: Subject to any disclaimer, the term of this patent is extended or adjusted under 35 U.S.C. 154(b) by 0 days.

(21) Appl. No.: 15/466,813

(22) Filed: Mar. 22, 2017

(30) Foreign Application Priority Data

Jul. 15, 2016 (CN) ..... 2016 2 0743184 U

(51) Int. Cl.
*A47F 5/08* (2006.01)
*E05B 73/00* (2006.01)

(52) U.S. Cl.
CPC ..... *A47F 5/0861* (2013.01); *A47F 5/0838* (2013.01); *E05B 73/00* (2013.01); *A47F 5/0823* (2013.01)

(58) Field of Classification Search
CPC .... A47F 5/0861; A47F 5/0838; A47F 5/0823; E05B 73/00
USPC ..... 211/7, 54.1, 57.1, 4, 59.1; 248/220.31, 248/225.21, 304, 690, 303; 70/14, 57.1, 70/58, 61, 62, 270, 393
See application file for complete search history.

(56) References Cited

U.S. PATENT DOCUMENTS 1,930,656 A * 10/1933 Nave ..... F25D 23/067 248/239
2,596,287 A * 5/1952 Richardson ..... A47G 25/10 211/32
3,998,332 A * 12/1976 Lambertson ..... A47F 5/0838 182/92
4,394,909 A * 7/1983 Valiulis ..... A47F 5/0823 211/59.1
4,474,300 A * 10/1984 Entis ..... A47F 5/0823 211/4
4,783,033 A * 11/1988 Valiulis ..... A47F 5/0823 211/59.1
4,801,116 A * 1/1989 Blankenship ..... A47F 5/0823 211/59.1
4,823,964 A * 4/1989 Lundberg ..... A47F 5/0869 211/57.1
4,850,557 A * 7/1989 Valiulis ..... A47F 5/0823 211/57.1
4,869,376 A * 9/1989 Valiulis ..... A47F 5/0823 211/54.1

(Continued)

*Primary Examiner* — Joshua J Michener
*Assistant Examiner* — Devin Barnett

(57) ABSTRACT

A merchandise security hook, comprising a base, a backboard, an upper iron wire, a lower iron wire, a lock sleeve, a key, a rotary core and an example merchandise, wherein a short hook is arranged between the lower iron wire and the backboard, the base is arranged between the upper iron wire and the backboard and is connected with the upper iron wire through a pressing piece and a pressing screw, a base spring is sleeved on the lower iron wire, a lock sleeve is arranged at an end of the lower iron wire, a plastic stop block is arranged between the lock sleeve and the upper iron wire, a label and a return spring are arranged at an end of the upper iron wire. The merchandise security hook is designed reasonable and easy to use.

5 Claims, 1 Drawing Sheet

(56) References Cited

U.S. PATENT DOCUMENTS 5,236,163 A * 8/1993 Valiulis ..... A47F 5/0869 211/57.1
5,429,334 A * 7/1995 Hutchison ..... A47F 5/0869 211/59.1
5,441,161 A * 8/1995 Merl ..... A47F 5/0838 211/57.1
5,597,150 A * 1/1997 Stein ..... A47F 5/0861 211/57.1
5,671,851 A * 9/1997 Johnson ..... A47F 1/128 211/106
5,676,258 A * 10/1997 Leyden ..... A47F 5/0861 211/59.1
5,689,978 A * 11/1997 Eklof ..... A47F 5/0861 211/4
6,003,685 A * 12/1999 Malin ..... A47F 5/0861 211/59.1
6,131,748 A * 10/2000 Kawasaki ..... A47F 1/128 211/54.1
6,209,831 B1 * 4/2001 Kiplinger ..... A47F 5/0869 211/59.1
6,474,478 B1 * 11/2002 Huehner ..... A47F 5/0861 211/4
6,957,555 B1 * 10/2005 Nagel ..... A47F 5/0861 211/57.1
7,197,902 B1 * 4/2007 Barkdoll ..... A47F 5/0861 211/57.1
7,269,983 B1 * 9/2007 Mchatet ..... A47F 5/0861 70/14
7,392,673 B2 * 7/2008 Fawcett ..... A47F 5/0861 211/7
7,909,183 B2 * 3/2011 Oh ..... A47F 5/0823 211/59.1
8,240,486 B2 * 8/2012 Niederhuefner ..... A47F 1/128 211/51
8,266,933 B2 * 9/2012 Bishir, Jr. ..... E05B 67/24 124/86
8,281,625 B2 * 10/2012 Prescott ..... B60R 9/048 211/5
8,286,454 B2 * 10/2012 Richardson ..... A47F 5/0861 211/7
8,302,923 B2 * 11/2012 Johnston ..... A47F 5/0823 211/57.1
8,307,995 B2 * 11/2012 Surma ..... A47F 5/0861 211/59.1
8,534,469 B2 * 9/2013 Northrup, Jr. ..... A47F 5/0861 211/57.1
8,567,220 B1 * 10/2013 Mchatet ..... A47F 5/0838 211/4
8,629,772 B2 * 1/2014 Valiulis ..... G08B 13/149 211/57.1
8,667,818 B1 * 3/2014 Mchatet ..... A47F 5/0861 211/4
9,078,532 B1 * 7/2015 Mchatet ..... E05B 73/00
2001/0013567 A1 * 8/2001 Valiulis ..... A47F 5/0861 248/220.41
2004/0026344 A1 * 2/2004 Sedon ..... A47F 5/0861 211/7
2004/0035809 A1 * 2/2004 Su ..... A47F 3/0469 211/86.01
2004/0182801 A1 * 9/2004 Sedon ..... A47F 5/0861 211/59.1
2005/0029205 A1 * 2/2005 Mansfield ..... A47F 5/0861 211/7
2005/0040122 A1 * 2/2005 Ahlund ..... A47F 5/0838 211/59.1
2005/0167376 A1 * 8/2005 Carter ..... G09F 23/00 211/59.1
2006/0157431 A1 * 7/2006 Nagelski ..... A47F 5/0861 211/54.1
2006/0261016 A1 * 11/2006 Magid ..... A47F 5/0823 211/57.1
2007/0102379 A1 * 5/2007 Strand ..... A47F 5/0823 211/59.1
2007/0119796 A1 * 5/2007 Barkdoll ..... A47F 5/0861 211/54.1
2007/0241069 A1 * 10/2007 Nagelski ..... A47F 5/0823 211/57.1
2007/0267363 A1 * 11/2007 Weck ..... G09F 3/20 211/59.1
2007/0283615 A1 * 12/2007 Vlastakis ..... A47F 5/0861 43/55
2008/0168811 A1 * 7/2008 Nagelski ..... E05B 19/046 70/276
2008/0169250 A1 * 7/2008 Nagelski ..... A47F 5/0861 211/7
2008/0203253 A1 * 8/2008 Vogler ..... A47F 1/128 248/220.31
2008/0209960 A1 * 9/2008 Nagelski ..... A47F 5/0861 70/57.1
2009/0057244 A1 * 3/2009 Conti ..... A47F 5/0861 211/7
2009/0173853 A1 * 7/2009 Fawcett ..... A47F 5/0861 248/220.31
2010/0175438 A1 * 7/2010 Sankey ..... E05B 19/046 70/57.1
2010/0223965 A1 * 9/2010 Richardson ..... A47F 5/0861 70/58
2010/0300992 A1 * 12/2010 Surma ..... A47F 5/0861 211/7
2011/0036789 A1 * 2/2011 Richardson ..... A47F 5/0861 211/1.57
2011/0127225 A1 * 6/2011 Hooks, Jr. ..... A47F 5/0861 211/1.57
2012/0228447 A1 * 9/2012 Barkdoll ..... A47F 5/0823 248/220.22
2012/0305505 A1 * 12/2012 Barkdoll ..... A47F 5/0823 211/59.1
2013/0008863 A1 * 1/2013 Valiulis ..... A47F 1/128 211/59.1
2013/0105418 A1 * 5/2013 Northrup, Jr. ..... A47F 5/0861 211/4
2013/0105419 A1 * 5/2013 Kologe ..... A47F 5/0861 211/7
2014/0352372 A1 * 12/2014 Grant ..... A47F 5/0861 70/57.1
2015/0001167 A1 * 1/2015 Pena ..... A47F 5/0861 211/9
2015/0152670 A1 * 6/2015 Kopco ..... E05B 67/36 70/14
2015/0189999 A1 * 7/2015 Leyden ..... A47F 5/0861 211/7
2015/0211263 A1 * 7/2015 Bullwinkel ..... E05B 73/00 70/344
2017/0188723 A1 * 7/2017 Will ..... A47F 5/0861

* cited by examiner

MERCHANDISE SECURITY HOOK

CROSS REFERENCE TO RELATED APPLICATIONS

The present application claims the benefit of Chinese Utility Model Application No. 201620743184.5 filed on Jul. 15, 2016. All the above are hereby incorporated by reference.

FIELD OF THE INVENTION

The present invention relates to a hook, more particularly to a security hook for merchandise.

BACKGROUND OF THE INVENTION

The existing security hook is configured to include an iron wire part integrating a long hook and a short hook. By means of one front lock and one rear lock, respectively, it may be fixed on a backboard or unlocked to allow removal of articles. It is internally installed with a spring piece or a magnetic pin and its unlocking operation is carried out by the magnetism of the magnet, thus unlocking fault may occur due to the rust of the spring piece or the pin caused by air humidity. In addition, the configuration with two locks has high cost and low produce efficiency. To this end, a security hook for merchandise is provided here.

SUMMARY OF THE INVENTION

The present invention aims to provide a merchandise security hook which effectively solves the technical problems mentioned in the background.

In order to achieve such goal, the present invention provides a technical solution as below. A merchandise security hook comprises a base, a backboard, an upper iron wire, a lower iron wire, a lock sleeve, a key, a rotary core and an example merchandise, wherein a short hook is arranged between the lower iron wire and the backboard, the base is arranged between the upper iron wire and the backboard and is connected with the upper iron wire through a pressing piece and a pressing screw, a metal stop pin is arranged at an inner end of the lower iron wire, a retaining pin is arranged on one side of the metal stop pin, a base spring is arranged on one side of the retaining pin and is sleeved on the lower iron wire, a lock sleeve is arranged at an end of the lower iron wire, a plastic stop block is arranged between the lock sleeve and the upper iron wire, a label and a return spring are arranged at an end of the upper iron wire, a lock pin is arranged at an end of the connecting part between the key and the lock sleeve, a straight pin and a lock core spring are arranged beside the lock pin, a lock core is arranged within the lock sleeve, and the lock core is externally covered by a lock cover.

Preferably, a lock sleeve cap may be arranged on an upper portion of the connecting part between the lower iron wire and the lock sleeve, and may be arranged with a lock cap screw.

Preferably, a locking case may be arranged on one side of the bottom part of the lock core, a locking case retaining screw corresponding to the locking case may be fixedly arranged on an outer side of the lock sleeve.

Preferably, a return spring and the rotary core may be arranged at the bottom of the lock core.

Preferably, the example merchandise may be positioned below the lower iron wire.

Compared with existing devices, the present invention has advantages as follows.

1. The merchandise security hook is designed reasonable and easy to use. By means of one mechanical lock, associated control of picking and placing articles and fixing the hook on the backboard is achieved. Once the key is removed, the lock core mechanism provided within the lock sleeve may be restored automatically. After the articles are placed, the lock sleeve may be pushed so as to realize locking, such that associated locking and unlocking is achieved to allow picking and placing articles and fixing the hook on the backboard. The iron wire hook is divided into two parts, i.e. the upper iron wire part which is connected with the base and the label and on which the lock sleeve is movable forwardly and backwardly unless the lock core provided within the lock sleeve is engaged in the locking groove of the lower iron wire, and the lower iron wire part integrated with the short hook by welding. Therebetween, springs are cooperated with the base so as to achieve displacement limitation. By means of one mechanical lock mechanism in the front of the hook, installing of the hook and picking and placing of articles are controlled. It is easy to pick and place articles due to the mechanical lock core which is restorable automatically, whereby the service efficiency is increased and the cost is reduced.

2. In the case the security hook is in a locked state, the lock core is engaged in the locking groove of the lower iron wire, the spring presses against the base, the base and the upper iron wire are limited and are forwardly and backwardly unmovable along the lower iron wire, whereby the security hook is fixed on the backboard. Since the base is pressed by the spring force of the spring of the lower iron wire, it is securely fixed on the backboard even during locking and unlocking the hook and picking and placing articles. When the key is inserted to unlock it, the lock sleeve may be automatically unlocked by the spring, thus it is easy to remove articles. Once the key is removed, the lock core may be restored automatically, and the lock sleeve may be pushed and automatically locked. It suits to be used widely.

In the figures: 1. base; 2. backboard; 3. pressing piece; 4. pressing screw; 5. upper iron wire; 6. base spring; 7. metal stop pin; 8. retaining pin; 9. plastic stop block; 10. lock sleeve; 11. return spring; 12. label; 13. lock sleeve cap; 14. lock cap screw; 15. lock core; 16. lock core spring; 17. straight pin; 18. lock pin; 19. locking groove; 20. key; 21. spring for rotary core; 22. lock cover; 23. lower iron wire; 24. short hook; 25. return spring; 26. locking case; 27. example merchandise; 28. rotary core; 29. locking case retaining screw.

DETAILED DESCRIPTION OF ILLUSTRATED EMBODIMENTS

The present invention is further explained below in detail with reference to the figures and embodiments. These embodiments are to be understood as illustrative rather than limiting in nature.

Figure 1:
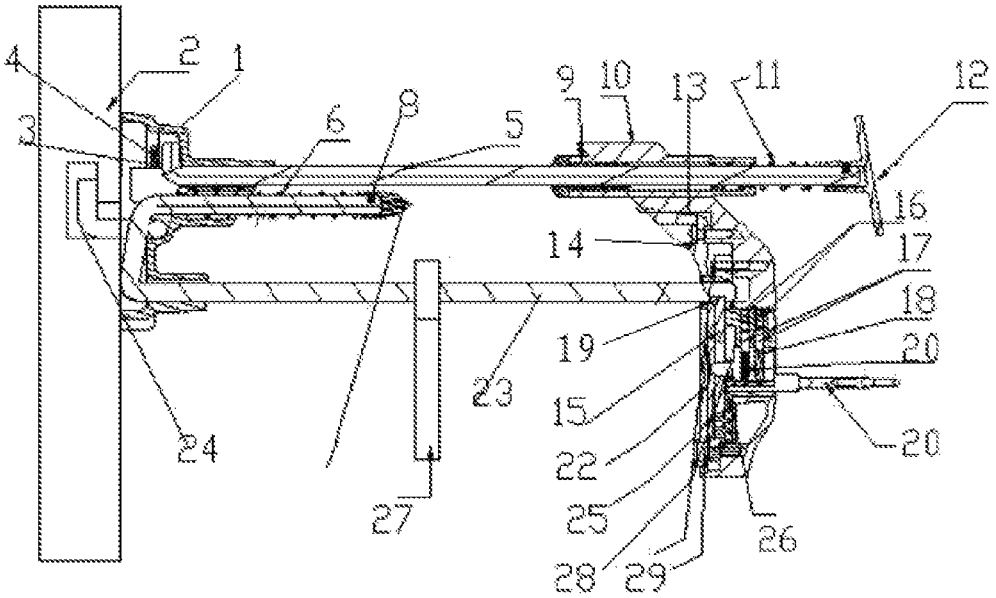
FIG. 1 is a schematic drawing of a merchandise security hook according to a preferred embodiment of the present invention, which is in a locked state.
Figure 2:
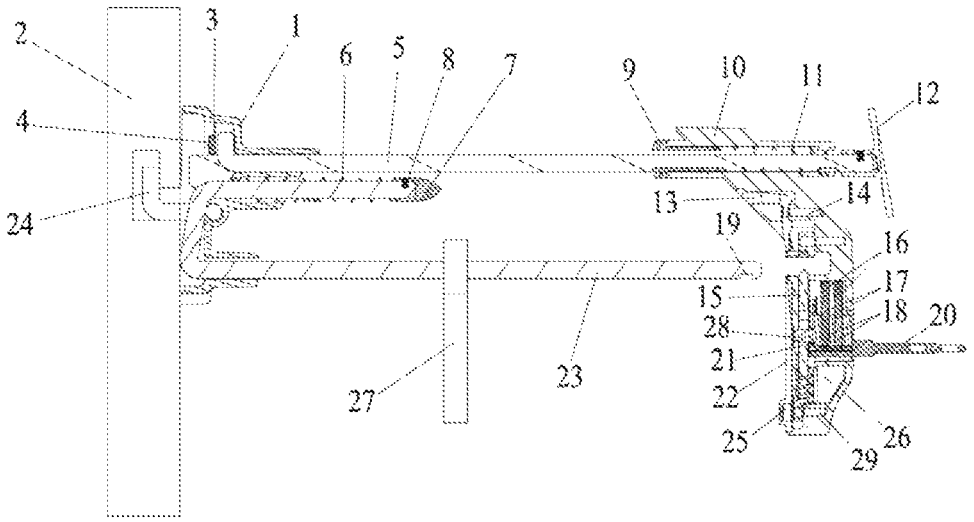
FIG. 2 is a schematic drawing of a merchandise security hook according to a preferred embodiment of the present invention, which is in an unlocked state.

As illustratively shown in FIGS. 1-2, a merchandise security hook according to an embodiment of the present invention comprises a base 1, a backboard 2, an upper iron wire 5, a lower iron wire 23, a lock sleeve 10, a key 20, a rotary core 28 and an example merchandise 27, wherein a short hook 24 is arranged between the lower iron wire 23 and the backboard 2, the base 1 is arranged between the upper iron wire 5 and the backboard 2, the base 1 is connected with the upper iron wire 5 through a pressing piece 3 and a pressing screw 4, a metal stop pin 7 is arranged at an inner end of the lower iron wire 23, a retaining pin 8 is arranged on one side of the metal stop pin 7, a base spring 6 is arranged on one side of the retaining pin 8 and is sleeved on the lower iron wire 23, a lock sleeve 10 is arranged at an end of the lower iron wire 23, a plastic stop block 9 is arranged between the lock sleeve 10 and the upper iron wire 5, a label 12 and a return spring 11 are arranged at an end of the upper iron wire 5, a lock pin 18 is arranged at an end of a connecting part between the key 20 and the lock sleeve 10, a straight pin 17 and a lock core spring 16 are arranged on one side of the lock pin 18, a lock core 15 is arranged within the lock sleeve 10, and the lock core 15 is externally covered by a lock cover 22.

Therein, a lock sleeve cap 13 is arranged on an upper portion of a connecting part between the lower iron wire 23 and the lock sleeve 10, and is arranged with a lock cap screw 14.

Therein, a locking case 26 is arranged on one side of a bottom part of the lock core 15, a locking case retaining screw 29 corresponding to the locking case 26 is fixedly arranged on an outer side of the lock sleeve 10, and the rotary core 28 is arranged with a spring for the rotary core.

Therein, a return spring 25 and the rotary core 28 are arranged at the bottom of the lock core 15.

Therein, the example merchandise 27 is positioned below the lower iron wire 23, and the backboard 2 is provided with a locking groove.

The merchandise security hook according to an embodiment of the present invention as shown in FIG. 1 is in a locked state, wherein the lock sleeve 10 is jointly connected on a free end of the lower iron wire 23, with the locking groove 19, which is provided on the free end of the lower iron wire 23, rightly aligning with an end of the lock core 15, such that the end of the lock core 15 may be engaged in the locking groove 19. Since the lock core 15 is engaged in the locking groove 19, the lock sleeve 10 is locked by the lower iron wire 23 and is prevented from being detached from the free end of the lower iron wire 23. Since the example merchandise 27 is connected to the lower iron wire 23 which has the free end locked by the lock sleeve, the example merchandise 27 is prevented from being removed from the lower iron wire 23, thus the locking of the example merchandise 27 is achieved and the customer cannot just take it away.

The merchandise security hook according to an embodiment of the present invention as shown in FIG. 2 is in an unlocked state, wherein the locking groove 19 of the lower iron wire 23 is detached from the lock core, and the lock sleeve 10 is moved towards an outer end of the upper iron wire 5 under the force of the return spring 11, so as to return to an original state. Then, the free end of the lower iron wire 23 may be completely disengaged from the lock sleeve 10 and may be spaced from the lock sleeve 10, so as to facilitate the supplying of the example merchandise 27 to the lower iron wire 23 by the free end of the lower iron wire 23 through this interval.

In conjunction with FIGS. 1-2, the working principle of the merchandise security hook according to an embodiment of the present invention is illustrated as follows. At first, it is necessary to install the security hook on the backboard 2. In particular, the short hook 24 may be hooked in an installing groove of the backboard 2. In the case the base 1 is pulled, the base 1, the pressing piece 3, the pressing screw 4 and the upper iron wire 5 may be moved backwards together with the plastic stop block 9 and the label 12, against the spring force of the base spring 6. In the case the pull force disappears, the base 1 may press against the backboard 2 under the spring force of the base spring 6, so as to fasten the security hook to the backboard 2.

In order to lock the example merchandise 27, the key 20 may be removed from the lock sleeve 10 at first. Thus, the lock core 15 is rotated around the rotary core 28 under the spring force of the return spring 25 and the spring for rotary core of the rotary core 28, until the lock core 15 is rotated to an opening for restoring the lock sleeve 10. Meanwhile, due to the lock core spring 16, the lock pin 18 is pushed into an inner bore of the rotary core 28 by the straight pin 17 so as to prevent the rotating. Then, the example merchandise 27 may be connected to the lower iron wire 23 by the free end of the lower iron wire 23 through the interval between the free end of the lower iron wire 23 and the lock sleeve 10. After that, the lock sleeve 10 may be moved towards the free end of the lower iron wire 23, until it is engaged to the free end of the lower iron wire 23, with the locking groove 19 provided on the free end of the lower iron wire 23 rightly aligning with the end of the lock core 15, such that the end of the lock core 15 may be engaged in the locking groove 19. During the process, the rotary core 28 and the lock core 15 do not interfere with each other. In this way, after finishing the locking, the customer cannot just the take the merchandise away and the anti-theft function is achieved. Meanwhile, the base 1, the upper iron wire 5, the label 12 and the stop block 9 are stopped by the lock sleeve 10 and are unmovable, so that the short hook 24 cannot be removed from the backboard 2. By ultrasonic welding of the lock sleeve cap 13 and the lock sleeve 10, the lock core 15 may be fixedly arranged in the lock sleeve 10 by the lock cap screw 14.

In order to unlock it, the key 20 may be inserted into a keyhole. Thus, the bulge provided in the key may be rightly aligned with the lock pin 18 and the lock pin 18 may be pushed outwards by it until the straight pin 17 is moved out of the inner bore of the rotary core 28. Then, since the straight pin fails to lock the rotary core 28, the key can be rotated to enable the lock core 15 to be detached from the locking groove 19, such that the locking groove 19 of the lower iron wire 23 may be disengaged from the lock core. Then, the lock sleeve 10 may be moved towards the outer end of the upper iron wire 5 under the force of the return spring 11, so as to return to an original state and thus realize the unlocking.

All the above are merely the preferred embodiments of the present invention. The present invention is intended to cover all changes, various modifications and equivalent arrangements included within the principle and scope of the present invention according to the technical essence of the present invention.

What is claimed is:

1. A merchandise security hook, comprising a base, a backboard, an upper iron wire, a lower iron wire, a lock sleeve having an upper channel configured to receive the upper iron wire and a lower cavity, a key, a rotary core and a merchandise item, wherein a short hook is arranged between the lower iron wire and the backboard in order to attach the merchandise security hook to the backboard, the base is arranged between the upper iron wire and the backboard and is connected with the upper iron wire through a pressing piece and a pressing screw, a metal stop pin is arranged at an end in an inner side of the lower iron wire, a retaining pin is arranged on one side of the metal stop pin, a base spring is arranged on one side of the retaining pin and is sleeved on the lower iron wire, the lower cavity of the lock sleeve is configured to receive an end of the lower iron wire, a plastic stop block is arranged between the lock sleeve and the upper iron wire, a label and a first return spring are arranged at an end of the upper iron wire, a lock pin is arranged below the lower cavity, a straight pin and a lock core spring are arranged on one side of the lock pin, a lock core is arranged within the lock sleeve, and a lock cover is externally arranged on the lock core.

2. The merchandise security hook according to claim 1, wherein a lock sleeve cap is arranged between the lower iron wire and the upper channel of the lock sleeve, and the lock sleeve cap is arranged with a lock cap screw.

3. The merchandise security hook according to claim 1, wherein a locking case is arranged on one side of a bottom part of the lock core, and a locking case retaining screw corresponding to the locking case is fixedly arranged on an outer side of the lock sleeve.

4. The merchandise security hook according to claim 1, wherein a second return spring and the rotary core are arranged at the bottom part of the lock core.

5. The merchandise security hook according to claim 1, wherein the merchandise item is suspended from the lower iron wire.

* * * * *